US005082289A

United States Patent [19]

Paranto et al.

[11] Patent Number: 5,082,289

[45] Date of Patent: Jan. 21, 1992

[54] REBOUND GAME GARMENT

[76] Inventors: Steve A. Paranto, 2375 SW. Augusta Pl., Aloha, Oreg. 97006; Arlen C. Paranto, Box 304, Eatonville, Wash. 98328

[21] Appl. No.: 608,711

[22] Filed: Nov. 5, 1990

[51] Int. Cl.[5] ..... A63B 67/00; A41D 13/04

[52] U.S. Cl. ..... 273/318; 2/49 R; 2/52; 273/412; 273/342; 273/DIG. 19

[58] Field of Search ..... 273/318, 342, 412, DIG. 17, 273/DIG. 18, DIG. 19, 319, 329, 330, 331, 340, 1 R; 2/46, 49 R, 50, 51, 52

[56] References Cited

U.S. PATENT DOCUMENTS

| | | | |
|---|---|---|---|
| 1,568,826 | 1/1926 | Gallemore | 2/51 |
| 1,797,208 | 3/1931 | Weisz | 2/51 |
| 2,148,152 | 2/1939 | Dosberg | 2/52 |
| 2,423,002 | 6/1947 | Bray | 2/52 |
| 3,341,201 | 9/1967 | Ryan | 273/DIG. 17 X |
| 3,404,407 | 10/1968 | Lapidus | 2/49 R |
| 3,471,154 | 10/1969 | Saunders | 273/DIG. 19 X |
| 3,612,525 | 10/1971 | Carter | 273/DIG. 19 X |
| 3,778,055 | 12/1973 | Witkowski | 273/1 R |
| 4,247,117 | 1/1981 | Reichert | 273/411 |
| 4,291,885 | 9/1981 | Cohen | 273/DIG. 19 X |
| 4,427,117 | 1/1984 | Matthewson | 414/678 X |

*Primary Examiner*—William H. Grieb
*Attorney, Agent, or Firm*—Robert W. Jenny

[57] ABSTRACT

The subject garment comprises a rectangular piece of sheet material. When the garment is worn by a user one end of the piece is held against or close to the user's chest in a line between the user's armpits and midway between them. The corners of the other end are grasped in the user's hands and the piece is held in a generally horizontal position. Objects striking the piece can then be caused to rebound from it and the trajectory of the rebounded object can be influenced by manipulation of the piece. In a preferred embodiment the sheet material is elastic and the garment comprises adjustable straps arranged to position the piece on the wearer as described above. The garment is used in play and games in which an object such as a ball is repeatedly rebounded from the garment.

1 Claim, 1 Drawing Sheet

REBOUND GAME GARMENT

BACKGROUND OF THE INVENTION

1. Field

The subject invention is in the field of apparatus used to repeatedly cause an object to rebound off the apparatus, tennis rackets and ping-pong paddles being typical of such apparatus. More specifically it is in the field of such apparatus made with sheet material or fabric and, still more specifically being a garment or part of a garment.

2. Prior Art

There is little prior art to the subject invention known to the inventor. U.S. Pat. No. 4,247,117 shows a harness, which could be considered to be a garment, to which a ball is tethered by an elastic cord. The cord causes the ball to return toward the wearer of the harness after the ball has been propelled away from the wearer. No rebound is involved. Trampolines are another example of prior art to the subject invention in that they comprises elastic material or elastically supported material on which the users rebound repeatedly. Blankets used in blanket tossing people and firemen's rescue apparatus for safely arresting the fall of people are further examples. None of the known prior art provides garments or parts of garments made of sheet material for causing rebounding of objects striking the material.

Accordingly the prime objective of the subject invention is to provide such a garment. For purposes of simplifying this disclosure the term garment includes garments in which a part of the garment provides the capability for rebounding objects. Further objectives are that the invention be: safe, lightweight, durable, compactable for storage, readily manufacturable and adjustable to suit a range of sizes of users. Another further objective is that the safety be based on the facts that the invention has no hard and/or sharp components and that the user's limbs are in no way encumbered in use of the invention.

SUMMARY OF THE INVENTION

The subject invention is a garment with which the wearer can cause objects contacting the garment to rebound and can influence the trajectory of the rebounding object. This garment can be used for play similar to bouncing a ball and for games similar to ping-pong, badminton or volleyball.

The garment comprises a four-sided piece of elastic material. The width of the piece is in the range of distances between user's armpits and its length is in the range of the lengths of user's arms, a preferred length being approximately ¾ the distance from a user's chest to the user's thumbs with user's arms bent slightly. In use one of the "width" ends of the piece is attached across the user's chest at armpit level and the corners of the piece at the other "width" end are each held by one of the user's hands. When the material is held taut it forms a rebound surface which can be manually controlled by the user/wearer to influence the rebound trajectory and velocity of an object which strikes and rebounds from the material.

For purposes of this disclosure the piece is termed "rebounder".

The rebounder may be attached as described by, for examples, being sewn into a shirt type garment, or by a harness comprising strips of material termed straps for purposes of this disclosure. In a preferred embodiment, one strap is fastened to one corner of the rebounder, runs under one armpit of the wearer, across the wearer's back and under the other armpit to be attached to a second corner of the rebounder. A second strap runs from the first corner, over one of the wearer's shoulders to the center of the first strap and then over the other shoulder to the second corner of the rebounder. The straps are attached to the rebounder by buckles so that their effective lengths and positions are adjustable.

The edges of the rebounder are reinforced without limiting their elasticity significantly, by hemming, double hemming or incorporation of reinforcement cords.

The invention is described in more detail below with reference to the attached drawings.

DETAILED DESCRIPTION OF THE INVENTION

Figure 1:
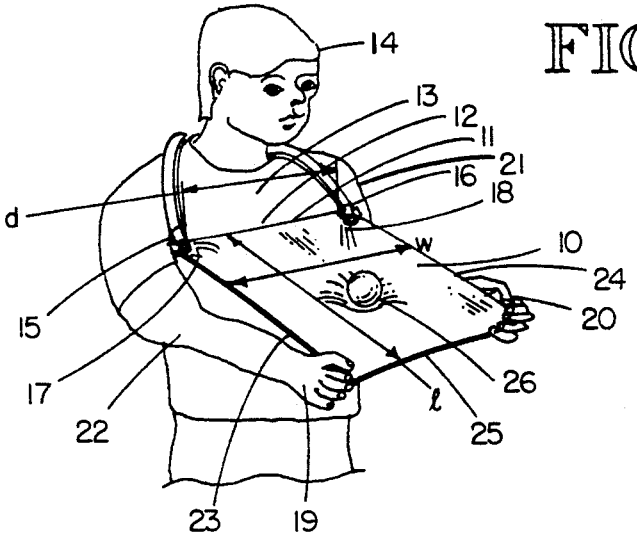
FIG. 1 is an illustration of the subject garment worn by a user and in use.

The subject invention is a garment with which a wearer can cause objects contacting the garment to rebound and influence the rebound trajectory. As shown in FIG. 1, illustrating a preferred embodiment of the garment in use, the garment comprises a four-sided piece 10 of elastic material attached at end 11 of the piece across front 12 of chest 13 of user 14, extending from armpit 15 to armpit 16 and attached to straps described below. Corners 17 and 18 of the piece, called a rebounder for purposes of this disclosure, are each gripped by one of the user's hands 19 and 20. Preferably the width w of the rebounder is in the range of 70% to 100% of the distance d from armpit to armpit and the rebounder is centered on the user's chest. Also preferably the minimum length 1 of the rebounder is such that when its unattached corners are held as shown, user's arms 21 and 22 are slightly flexed. The length may be such that with user's arms flexed as shown and user's hands grasping edges 23 and 24, end 25 is free.

In use the rebounder is held taut and when an object such as ball 26 contacts the rebounder, the rebounder is moved to cause the object to rebound and maneuvered to influence the trajectory of the object. The garment can be used in this way for play by one person or in a variety of games in which the object is rebounded from person to person or through hoops, over nets, at targets and the like.

Figure 2:
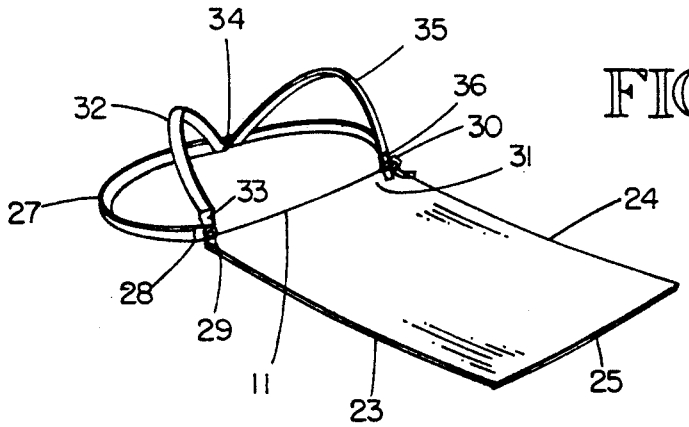
FIG. 2 illustrates the garment in more detail.

The garment is shown in more detail in FIG. 2 with its parts numbered as in FIG. 1. Strap 27 is visible in this view and is attached to the rebounder by buckle 28 at corner 29 and buckle 30 at corner 31. The buckles are sewn into the corners or may be attached by snaps or the like. Strap 32 is attached by buckle 33 to corner 29 and to strap 27 at 34. Strap 35 is attached by buckle 36 to corner 31 and to strap 27 at 34. Straps 32 and 35 may be one piece. The straps are adjusted at the buckles so that they fit snugly on the wearer and so that point 34 is a midpoint essentially at the center of the wearer's back. Edges 11, 23, 24, and 25 are reinforced to increase their durability and make them easier to grasp securely. The reinforcement is provided by any appropriate techniques known in the art, such as hemming, double hemming and incorporation of a reinforcing cord. In any case the reinforcing is done in a way which does not significantly limit the elasticity of the fabric.

The invention is useful with rebounders made from essentially nonelastic material. Elastic material is preferred, either elastomeric sheet or elastic fabric. Elastic fabric may be, as termed in the art, two way stretch or four way stretch. The term material also includes nets for purposes of this disclosure.

In alternate embodiments the attached end of the rebounder may be attached to a shirt worn by the user, attached by sewing or buttons or the like. The garment may be equipped with a pocket or slit so that the rebounder can be stored between the shirt and the user's body when not in use.

It is considered to be understandable from this description that the subject invention meets its objectives. It provides a garment comprising sheet material for causing rebounding of objects striking the material. It is safe in that there are no hard or sharp parts involved and the user's limbs and hands are not encumbered. It is also lightweight, durable, compactable for storage, readily adjustable and readily manufacturable.

It is also considered to be understandable that while certain embodiments of the invention are described herein, other embodiments or modifications of those described are possible within the scope of the subject invention which is limited only by the attached claims.

I claim:

1. A garment for use by a user having a chest, a back, first and second armpits and first and second shoulders, said garment comprising, in combination, a sheet of material being four sided and having a first end and a second end, a first side and a second side and means for attaching said first end of said sheet of material to said user across said chest midway between said armpits, said first side joining said first end to form a first corner, said second side joining said first end to form a second corner, said means for attaching comprising:

a first strap having first and second ends and a midpoint, said first end being adjustably attached at said second corner, a second strap having third and fourth ends, said third end being adjustably attached to said first corner, said fourth end being attached to said first strap at said midpoint and a third strap having fifth and sixth ends, said fifth end being adjustably attached to said second corner, said sixth end being attached to said first strap at said midpoint, said second and third straps being positioned to hold said first strap in said armpits, whereby said garment is donned by said user by placing said first strap under said first armpit across said back and under said second armpit and placing said second strap over said first shoulder and said third strap over said second shoulder.

* * * * *